US005193986A

United States Patent [19]

Grant et al.

[11] Patent Number: 5,193,986

[45] Date of Patent: Mar. 16, 1993

[54] FLUID PUMP

[75] Inventors: Benton H. Grant, Stamford, Conn.; Robert R. Stein, Harrison, N.Y.

[73] Assignee: Grant Manufacturing Corporation, Vanderbilt, Mich.

[21] Appl. No.: 817,340

[22] Filed: Jan. 6, 1992

[51] Int. Cl.[5] ..... F04B 9/08; F04B 35/02; F04F 11/00

[52] U.S. Cl. ..... 417/98; 417/413; 417/384; 417/568

[58] Field of Search ..... 417/98, 413, 384, 385, 417/386, 387, 388, 568, 383, 92, 99

[56] References Cited

U.S. PATENT DOCUMENTS

| | | | |
|---|---|---|---|
| Re. 26,509 | 12/1968 | Walton . | |
| 2,816,514 | 12/1957 | Freese . | |
| 2,888,877 | 6/1959 | Shellman et al. . | |
| 2,918,219 | 12/1959 | MacCracken . | |
| 3,016,840 | 1/1962 | Frick . | |
| 3,039,272 | 6/1962 | Frick . | |
| 3,443,519 | 5/1969 | White . | |
| 3,606,595 | 9/1971 | Takamizawa . | |
| 3,750,840 | 8/1973 | Holme . | |
| 3,756,748 | 9/1973 | Thiele . | |
| 3,838,944 | 10/1974 | Kolfertz . | |
| 3,936,243 | 2/1976 | Gakenholz . | |
| 3,955,901 | 5/1976 | Hamilton . | |
| 4,025,121 | 5/1977 | Kleysteuber et al. . | |
| 4,207,034 | 6/1980 | Zeimer . | |
| 4,222,127 | 9/1980 | Donachy et al. . | |
| 4,553,532 | 11/1985 | Bohls . | |
| 4,582,465 | 4/1986 | Bucher . | |
| 4,610,608 | 9/1986 | Grant | 417/413 |
| 4,627,419 | 12/1986 | Hills . | |
| 4,634,430 | 1/1987 | Polaschegg | 604/4 |
| 4,662,829 | 5/1987 | Nehring . | |
| 4,687,423 | 8/1987 | Maget et al. . | |
| 4,729,722 | 3/1988 | Toth . | |
| 4,808,089 | 2/1989 | Buchholtz et al. . | |
| 4,829,616 | 5/1989 | Walker . | |
| 4,830,586 | 5/1989 | Herter et al. . | |
| 4,834,625 | 5/1989 | Grant | 417/413 |
| 4,904,165 | 2/1990 | Fraser, Jr. et al. . | |
| 4,936,758 | 6/1990 | Coble . | |
| 4,986,738 | 1/1991 | Kawasaki et al. . | |
| 5,009,579 | 4/1991 | Grant | 417/413 |

FOREIGN PATENT DOCUMENTS

| | | | |
|---|---|---|---|
| 98287 | 6/1961 | Netherlands | 417/383 |
| 637589 | 5/1950 | United Kingdom | 417/386 |

*Primary Examiner*—Richard A. Bertsch
*Assistant Examiner*—Roland McAndrews
*Attorney, Agent, or Firm*—St. Onge Steward Johnston & Reens

[57] ABSTRACT

A fluid pump is provided which comprises a valveless pump chamber, a tube for conveying fluid, a conduit connecting the pump chamber and tube in fluid pressure communication, and at least one valve connected to the tube and adapted to permit a flow of fluid therethrough substantially in a single direction. Preferably at least the tube is removable and replaceable from the pump chamber. Preferably also, the tube is substantially rigid and includes a second valve at an opposite side of the conduit from the first valve.

25 Claims, 5 Drawing Sheets

FLUID PUMP

FIELD OF THE INVENTION

This invention relates to a fluid pump having a valveless pump chamber in fluid communication with a valved tube.

BACKGROUND OF THE INVENTION

Fluid pumps and diaphragm pumps are well known and widely used. Typically, such pumps have one or more pump chambers each of which includes an input port and an output port (see, for example, the pump disclosed in my earlier U.S. Pat. No. 4,610,608). In turn, each of these ports includes an input valve which will let air in to, but not out of, the pump chamber. The output port includes an output valve which will let air out of, but not in to, the pump chamber. These input and output valves are often provided as "flutter" valves which comprise a relatively thin membrane of material.

In addition to being difficult and expensive to assemble, these prior art pump designs are also difficult if not impossible, to service economically. For example, repair or replacement of valves often requires disassembly of not only the pump encasement, but also the pump chamber and/or reciprocating means. Pump designs including mufflers, timing mechanisms, or the like may require disassembly, reattachment and sealing of numerous fluid lines as well.

SUMMARY OF THE INVENTION

Accordingly it is an object of the invention to provide a fluid pump which is easier to assemble and disassemble. It is a further object of the invention to provide a fluid pump wherein valve repair and replacement may be more economically accomplished. It is another object of the invention to provide a fluid pump having a valveless pump chamber. It is still another object of the invention to provide a fluid pump in fluid communication with a separable valved tube.

These and other objects are achieved in the invention by provision of a fluid pump comprising a valveless pump chamber, a tube for conveying fluid, a conduit connecting the pump chamber and tube in fluid pressure communication, and at least one valve connected to said tube and adapted to permit a flow of fluid therethrough substantially in a single direction. Preferably at least the tube is removable and replaceable from the pump chamber. Preferably also, the tube is substantially rigid and includes a second valve at an opposite side of the conduit from the first valve.

In one embodiment, the fluid pump includes an enclosure, and the tube is preferably received and contained within the enclosure. In another embodiment, the pump chamber comprises a diaphragm pump chamber and the fluid pump includes means for reciprocating the diaphragm. In a third embodiment, the conduit includes a membrane to prevent mixing of fluid in the pump chamber with fluid in the tube.

The invention and its particular features will become more apparent from the following detailed description when considered with reference to the accompanying drawings.

DETAILED DESCRIPTION

Figure 1:
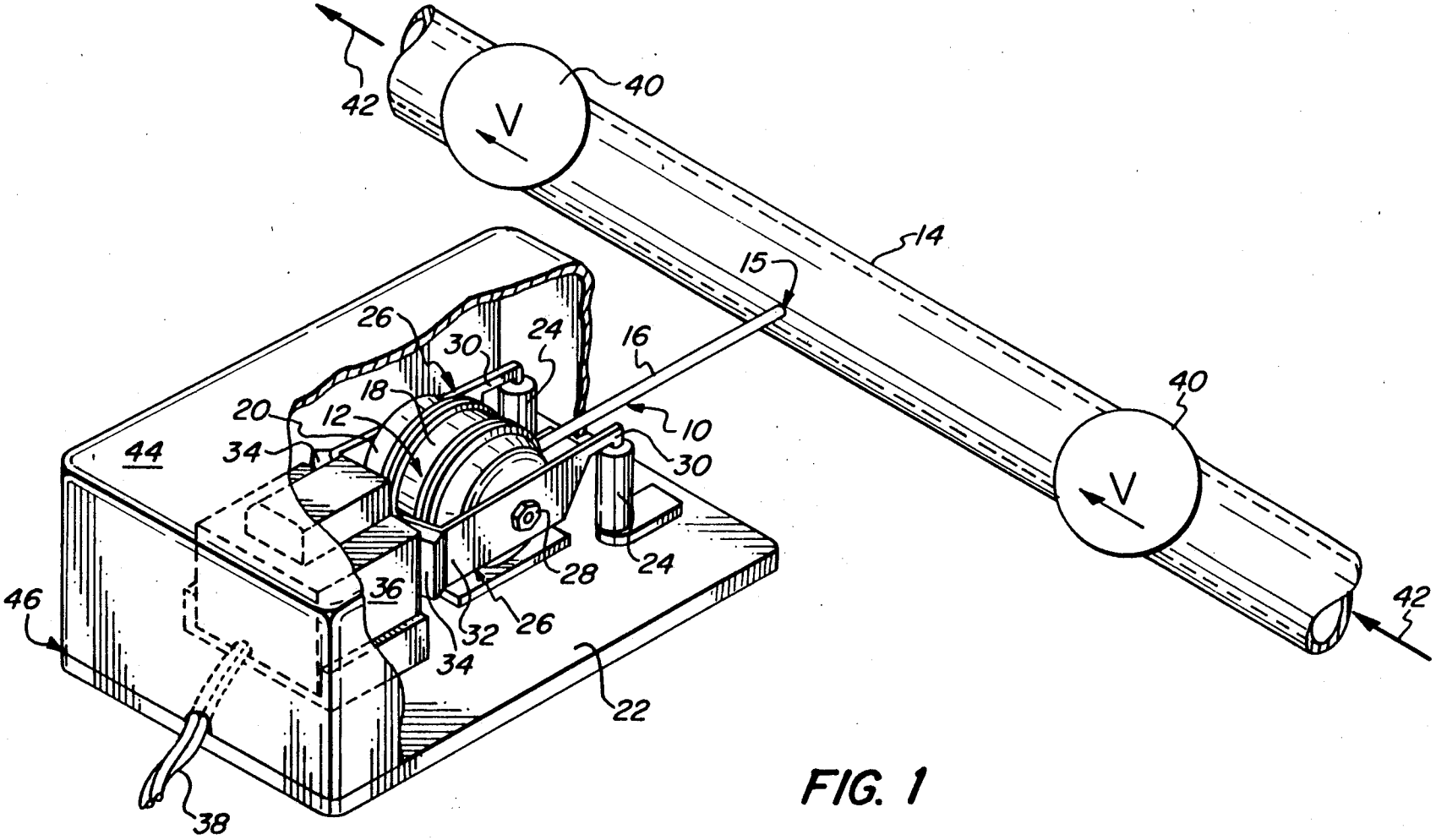
FIG. 1 is a partially cut away isometric view of one embodiment of a fluid pump in accordance with this invention.
Figure 2:
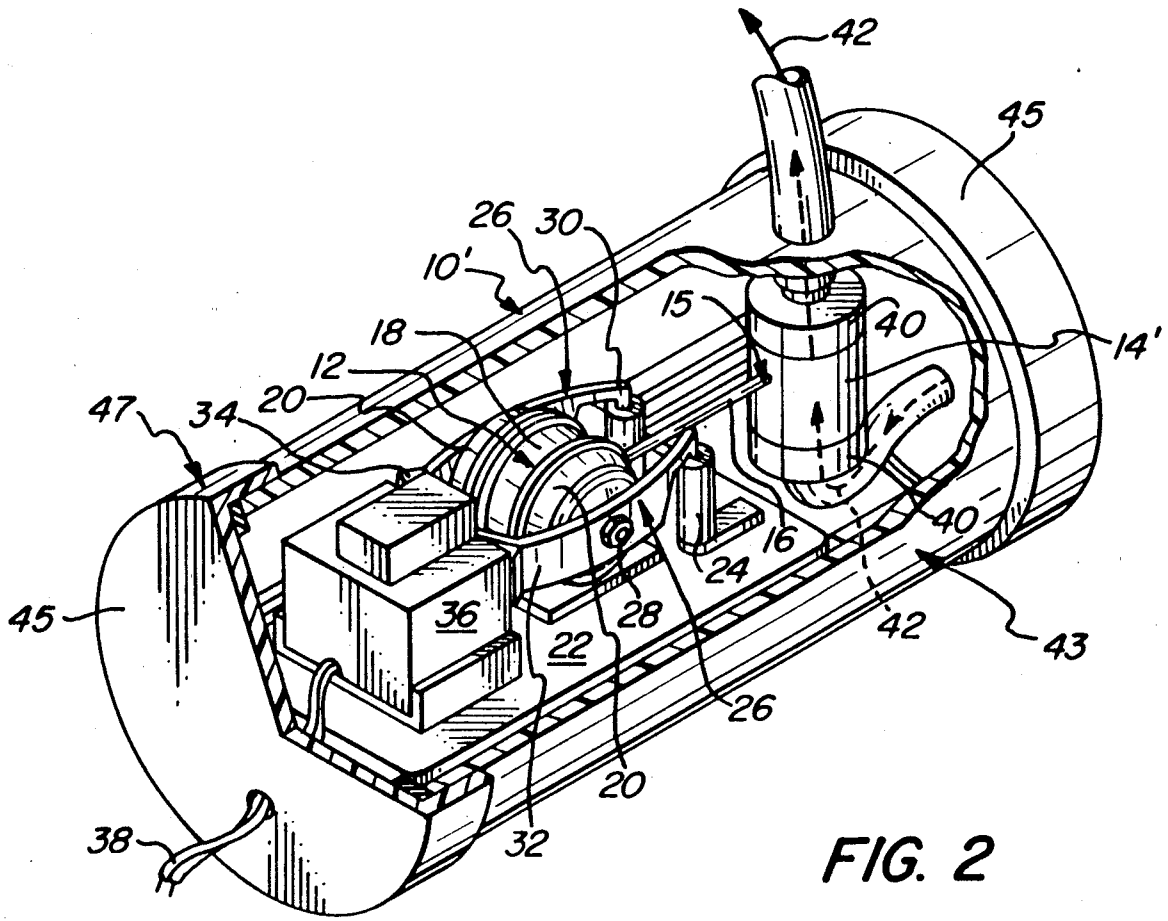
FIG. 2 is a partially cut away isometric view of another embodiment of a fluid pump in accordance with this invention.

FIGS. 1 and 2 depict different embodiments of a fluid pump 10, 10' respectively in accordance with the invention. Fluid pumps 10, 10' comprise a pump chamber 12, a tube 14, 14' for conveying fluid, and a conduit 16 connecting pump chamber 12 and tube 14, 14' in fluid communication. In fluid pump 10, tube 14 is located without the pump enclosure; whereas in fluid pump 10', tube 14' is located within the pump enclosure. Conduit 16 connects to pump chamber 12 via hole 13 therein, and to tube 14, 14' via a hole 15 therein. Holes 13 and 15 are preferably relatively small.

Pump chamber 12 is preferably a diaphragm pump chamber including a pump chamber wall 18 and at least one diaphragm 20, although many different types of pump chambers are possible and may work as well. More than one pump or "bellows" may be used with a single fluid conveying tube 14, 14'. Pump chamber 12 is mounted upon a base 22 which also includes pivot supports 24 for armatures 26. In this regard, pump chamber 12, and pivot supports 24 can be integrally formed with base 22 to achieve the advantages disclosed in my earlier U.S. Pat. No. 4,610,608.

Armatures 26 are secured to diaphragms 20 by a nut and bolt combination 28 or the like and are reciprocally pivotable to reciprocate diaphragms 20 and pump fluid. A pivot end 30 of armatures 26 is mounted to base 22 by pivot support 24, and a reciprocating end 32 of armatures 26 includes a magnet 34 and is reciprocated by an electromagnet 36 or like. Electromagnet 36 is energized by power cord 38.

Pump chamber 12 preferably includes no valves, greatly simplifying its assembly, repair and replacement, and reducing pump manufacturing labor and material costs.

Tube 14, 14' is preferably formed from a substantially rigid material, although tubes formed from other materials are possible. By "substantially rigid material" is meant that a cross-sectional area of the tube does not substantially change as fluid is passed therethrough by the fluid pump.

Tube 14, 14' includes at least one, and preferably two valves 40 (shown schematically) which are connected thereto and adapted to direct fluid through tube 14 substantially in a single direction as indicated by arrows 42. Thus, where two valves 40 are used, they preferably both direct fluid through tube 14, 14' in substantially the same direction. Also, where two valves 40 are used, they are located on opposite sides of conduit 16.

Preferably, tube 14, 14' is removable and replaceable from pump chamber 12. This permits replacement of valves 40 without necessitating disassembly and reassembly of pump chamber 12.

Like tubes 14, 14', conduit 16 may also be removable and replaceable from pump chamber 12 like tube. Additionally, conduit 16 may be removable and replaceable from tube 14, 14'.

Referring now to FIG. 1, a cover 44 attached to base 22 forms enclosure 46 which encloses at least: pump chamber 12, and at least a portion of conduit 16. Preferably, magnet 36 and armatures 26 are also enclosed by cover 14. In fluid pump 10 illustrated in FIG. 1, tube 14 is located completely without cover 44. Thus, valves 40 may be replaced even without disassembly and reassembly of enclosure 46. Placing tube 14 externally of enclosed pump chamber 12 permits a single pump chamber 12 to be used for pumping fluid through a variety of interchangeable tubes 14.

In fluid pump 10' illustrated in FIG. 2, however, conduit 16 and tube 14' are substantially completely enclosed by cylindrical cover 43 within which base 22 is mounted. End caps 45 are mountable to cylindrical cover 43 to form enclosure 47. In this embodiment, tube 14, 14' including valves 40, may be inserted and removed from enclosure 47 by removing an end cap 45.

Conduit 16 is preferably also formed from substantially rigid material, although conduits formed from other materials are possible and may work as well. Conduits 16 preferably, have a diameter which is less than or equal to about one-third times a diameter of tubes 14, 14'. Similar to tubes 14, 14', conduits 16 may be located completely within enclosure 16 and may also be removable and replaceable from pump chamber 12 through port 48 or by removing cover 44 from base 22.

Figure 3A:
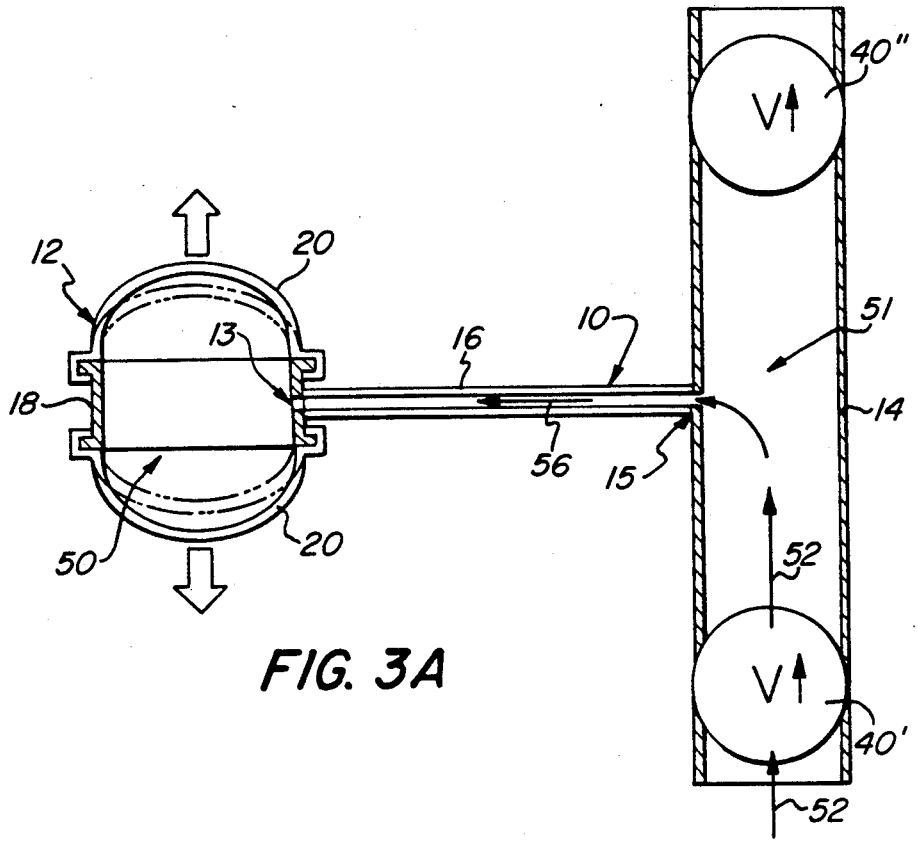
FIGS. 3A and 3B are schematic cross-sectional views of the fluid pump of FIGS. 1 or 2, illustrating operation thereof.
Figure 3B:
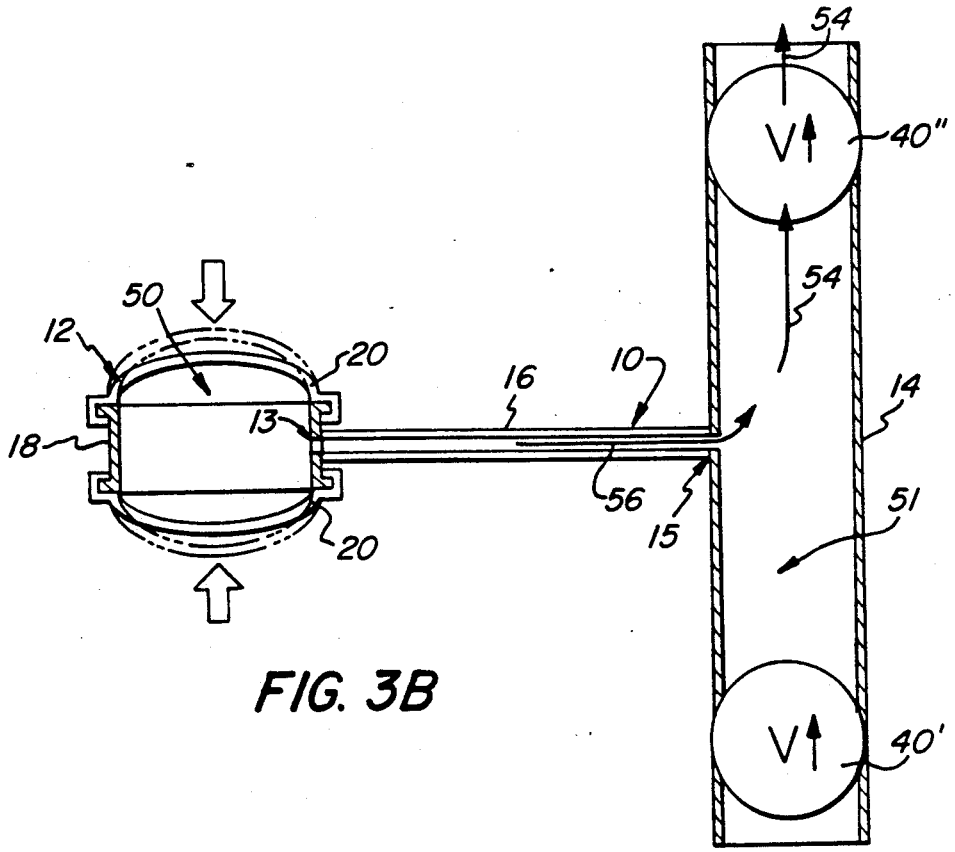

Referring now to FIGS. 3A and 3B, the operation of fluid pump 10 is schematically illustrated. Pump chamber wall 18 and diaphragms 20 (shown with dashed lines in their at rest positions) define a pump chamber volume 50. Similarly tube 14, 14' and valves 40', 40'' define a tube volume 51. During operation, diaphragms 20 reciprocate as indicated by the arrows and vary the pump chamber volume to alternately draw fluid along tube 14, 14' through an input valve 40' and into tube volume 51 as indicated by arrows 52, and pump fluid out of tube volume 51 further along tube 14, 14' through an output valve 40'' as indicated by arrows 54. Depending upon relative sizes of pump chamber and tube volumes, the pumping rate, supply fluid pressure, back fluid pressure, fluid viscosity and the like, fluid may or may not enter conduit 16 during operation. For purposes of example, fluid is shown entering conduit 16 by arrow 56. Also, depending upon similar variables, fluid may or may not enter pump chamber volume 50. In some applications, one fluid may substantially fill pump chamber volume 50 while another fluid is pumped along tube 14, 14'. In other applications a single fluid may fill or occupy pump chamber volume 50, conduit 16 and tube chamber 51.

Figure 4A:
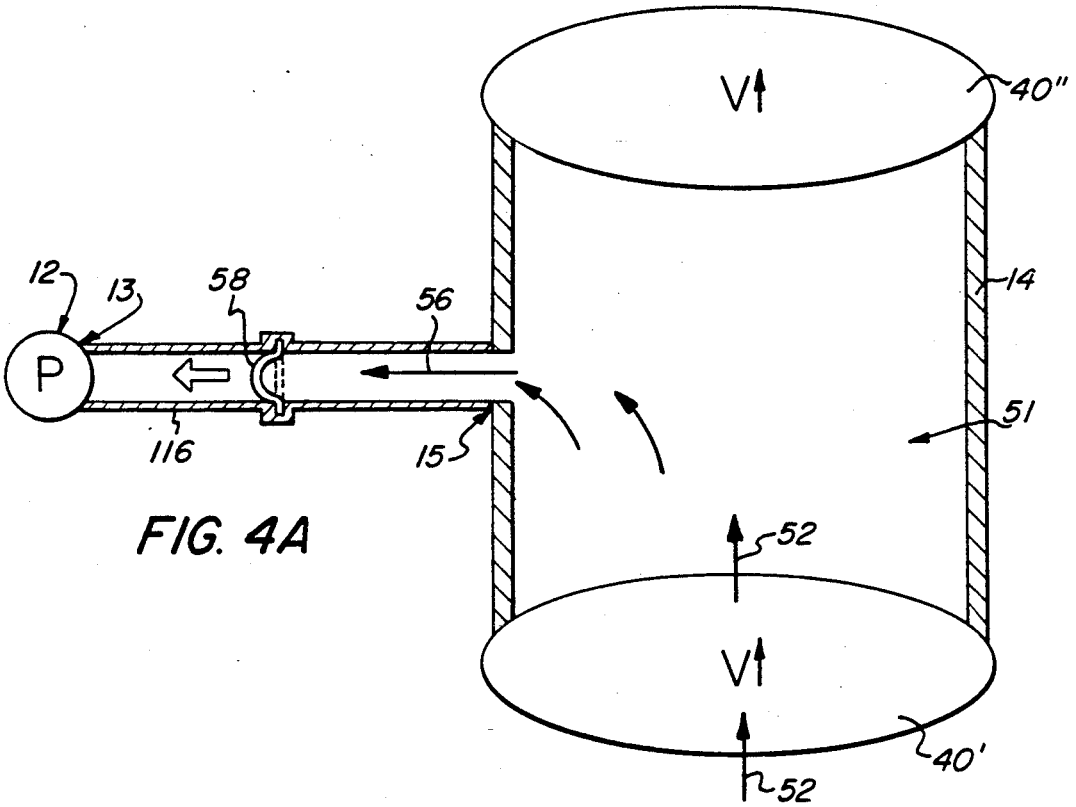
FIGS. 4A and 4B are schematic cross-sectional views of a third embodiment of a fluid pump in accordance with this invention, illustrating operation thereof.
Figure 4B:
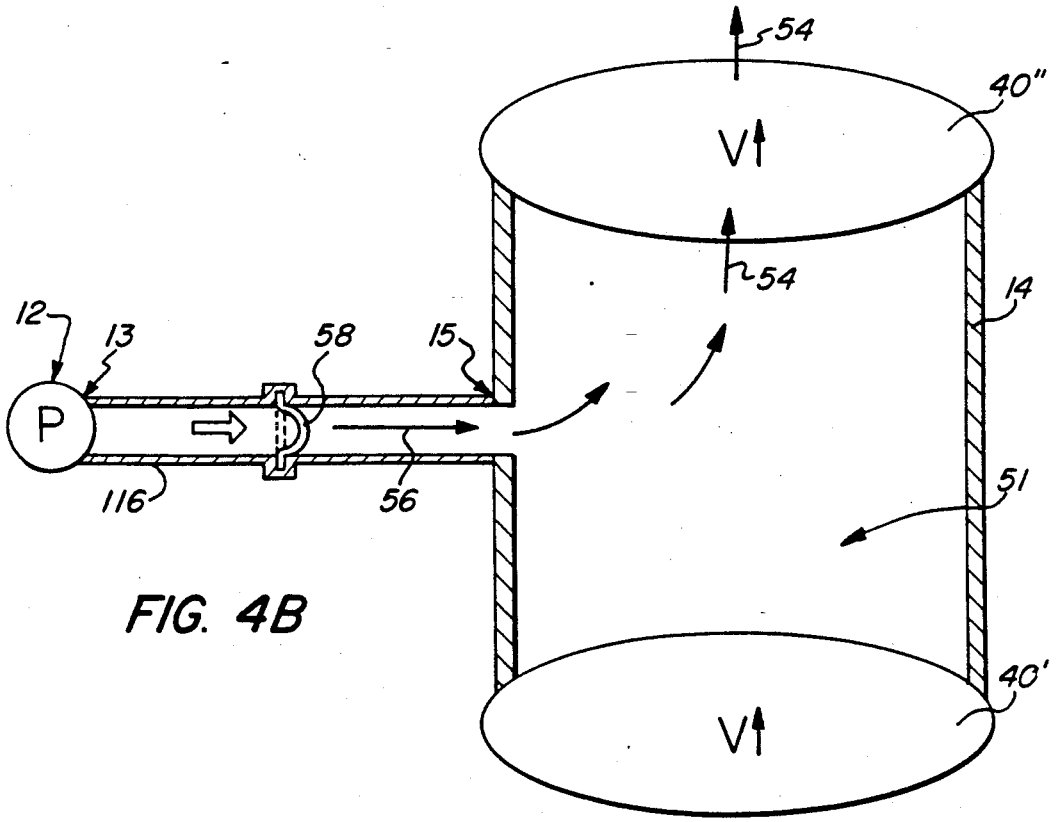

Referring now to FIGS. 4A and 4B, operation of another embodiment of fluid pump 10 is schematically depicted. In this embodiment a conduit 116 connects pump chamber 12 and tube 14, 14' in fluid pressure communication. Conduit 116 is different from conduit 16 only in that it includes a separating membrane 58 (shown in its at rest position in dashed lines). It is understood that conduit 116 also connects pump chamber 12 and tube 14, 14' in fluid pressure communication.

Membrane 58 reciprocates with the same frequency as diaphragms 20, and operation of fluid pumps 10 including conduit 116 is generally the same as operation with conduit 16. In this regard, conduit 116 prevents mixing of fluid in tube volume 51 with fluid in pump chamber volume 50.

Membrane 58 may also serve to substantially seal pump chamber 12 apart from tube 14, 14'. Conduit 116 may then be removed along with tube 14, 14' from pump chamber 12, and replaced with other tubes and conduits whereby pump chamber 12 may be used to pump a variety of fluids without mixing or contamination.

Figure 5:
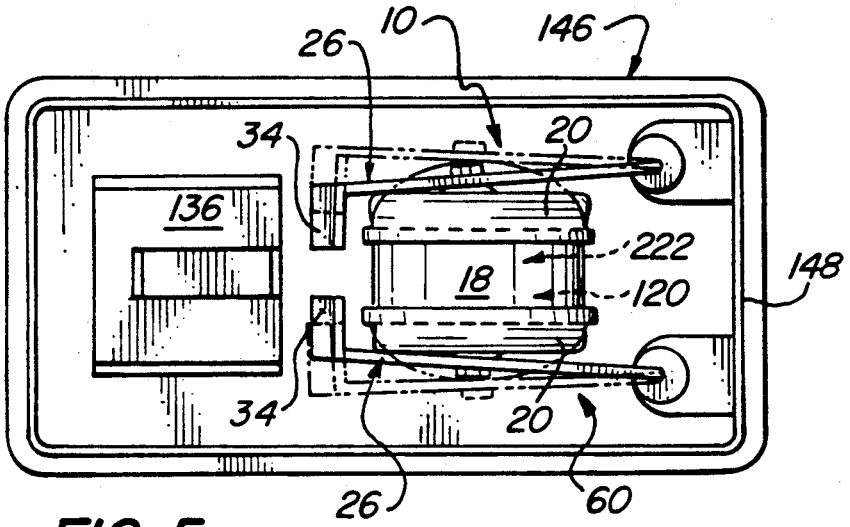
FIG. 5 and 6 are partial top plan views of the pump of FIG. 1 during operation in both a relatively highly pressurized enclosure (FIG. 5) and an unpressurized enclosure (FIG. 6) showing, for comparison, the at rest position of the armatures and diaphragms with ambient pressure on both sides of the diaphragms in dashed lines.
Figure 6:
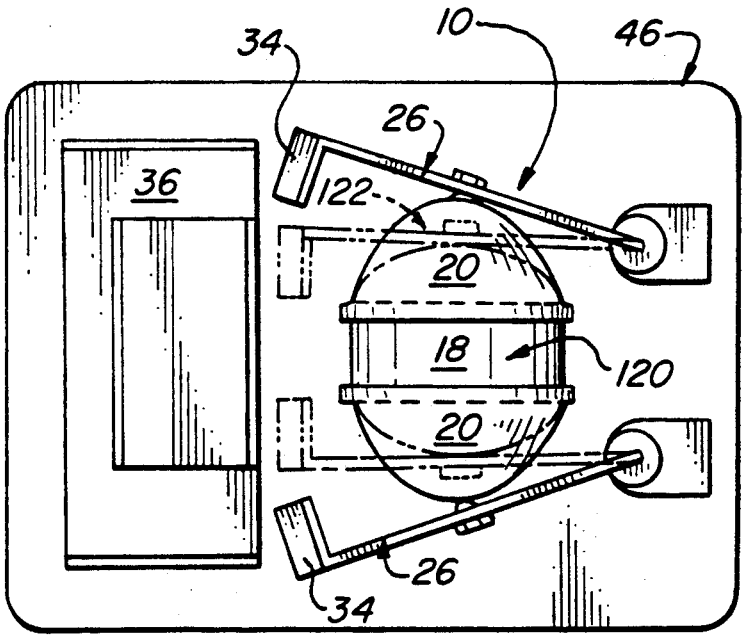
FIG. 6 (PRIOR ART)

Referring now to FIGS. 5 and 6, fluid pump 10 is depicted during operation in a relatively highly pressurized enclosure 146 (FIG. 5) sealed with ring 148 or the like, and in an ambient or unpressurized enclosure 46 (FIG. 6). Although only fluid pump 10 is illustrated, it is understood that fluid pump 10' may also be provided with a pressurized enclosure. For purposes of comparing the operating positions of diaphragms 20 and armatures 26 in the two different enclosures, the dashed lines depict diaphragms 20 and armatures 26 in their nonoperating, at-rest positions with ambient fluid pressures on both sides of diaphragms 20. A pump chamber resting volume 120 is defined as the volume defined by pump chamber wall 18 and diaphragms 20 under these at-rest conditions, and is illustrated by diaphragms 20 in their dashed-line positions.

In addition to depicting operation in their respective enclosure types, the solid lines depict diaphragms 20 and armatures 26 with an average operating pressure on the inner sides of diaphragms 20. It is understood that the actual instantaneous pressure on the inner sides of diaphragms 20 varies with reciprocation of diaphragms 20 as well as a back pressure from conduit 16 (see FIGS. 1 and 2).

Referring now to FIG. 6, a pump chamber operating volume 122 is defined as the volume within pump chamber wall 18 and diaphragms 20 under average operating conditions within ambient enclosure 46, and is illustrated by diaphragms 20 in their solid-line positions. Prior art enclosure 46 is unpressurized and pressurized fluid passing out of pump chamber 18 through conduit 16 is transmitted to a load (not shown in any Figure) such as an inflatable bladder. As fluid pump 10 operates, a back pressure develops through conduit 16 and back into pump chamber 18. This back pressure causes distension or ballooning of diaphragms 20 such that pump chamber operating volume 122 is larger than pump chamber resting volume 120 for fluid pumps 10 housed in prior art ambient pressure enclosures 46.

This ballooning of prior art diaphragm pumps gives rise to numerous disadvantages. Larger, more obtrusive enclosures are required to house the pumps. The diaphragms require more frequent replacement and a more secure seal to the pump chamber. A larger electromagnet 36 is required for efficient pump operation, i.e. to achieve proper registration of permanent magnets 34 with electromagnet 36.

Referring now to FIG. 5, these problems can be alleviated and additional advantages obtained by placing fluid pump 10 within pressurized enclosure 146. Regulating the pressure within enclosed space 60 at a level above ambient fluid pressure, i.e. at a level necessary to reduce distension of diaphragms 20, is all that is required. By pressurizing enclosure 146, the force of the back pressure tending to balloon diaphragms 20 effectively may be opposed. Thus, a pump chamber operating volume 222, defined as the volume within pump chamber wall 18 and diaphragms 20 under average operating conditions within pressurized enclosure 146, is smaller than pump chamber operating volume 122 (see FIG. 6). Diaphragms 20 last longer, and need not be as securely sealed to pump chamber 46 saving materials and labor in pump assembly. Smaller electromagnets 136 may be used while maintaining registration with permanent magnets 34 of armatures 26. Smaller, less obtrusive enclosures may be used. Further, the inventors have found that at loads of 64 inches of water, a diaphragm pump in pressurized enclosure 146 provides a flow rate of 1.6 liters per minute, while the identical pump in prior art enclosure 46 provides a flow rate of only 0.6 liters per minute. Thus, smaller pump chambers may be used to achieve similar flow rates. It has also been found that pressurized enclosures, especially where the enclosed pump pressurizes the enclosure, provide quieter pump assemblies, permitting muffler systems such as that disclosed in U.S. Pat. No. 4,610,608 to be eliminated.

Most preferably, the pressure of fluid within enclosed space 60 is regulated at a sufficiently high level that pump chamber operating volume 222 is less than pump chamber resting volume 120, although advantages may be obtained at any enclosed space pressure which reduces diaphragm distension. Also, fluid pump 10, itself, most preferably regulates the fluid pressure within enclosure 146.

Although the invention has been described with reference to particular embodiments, features, and the like, these are not intended to exhaust all possible features and indeed many modifications and variations will be ascertainable to those of skill in the art.

What is claimed is:

1. A fluid pump comprising:
- a substantially rigid tube;
- a pair of spaced apart valves connected to said tube, said valves adapted to permit a flow of fluid through said tube substantially in a single direction;
- a valveless pump chamber open to at least one side;
- a diaphragm for sealing the open side of said pump chamber;
- means for reciprocating said diaphragm; and
- a conduit connected in fluid communication with both said pump chamber and said tube between said valves,
- said tube having a diameter at least about three times larger than a diameter of said conduit, and having an inner surface contacted by the fluid as the flow passes through said tube.

2. The fluid pump of claim 1 wherein said conduit is substantially rigid.

3. The fluid pump of claim 1 wherein said conduit and said tube are removable and replaceable from said pump chamber.

4. The fluid pump of claim 1 wherein said conduit includes a membrane preventing mixing between fluid in said pump chamber and fluid in said tube.

5. The fluid pump of claim 1 wherein said tube is removable and replaceable permitting replacement of said valves without requiring disassembly of said pump chamber.

6. The fluid pump of claim 1 further comprising an enclosure for receiving and containing at least said pump chamber, said diaphragm, said conduit, at least a portion of said tube, and at least one of said valves.

7. A fluid pump assembly comprising:
- a valveless pump chamber open to two sides;
- a pair of diaphragms for sealing the open sides of said pump chamber;
- a tube for conveying fluid;
- a conduit for connecting said pump chamber in fluid communication with said tube; and
- at least one valve connected to said tube, and adapted to permit a flow of fluid therethrough substantially in a single direction.

8. The fluid pump assembly of claim 7 wherein said tube is substantially rigid.

9. The fluid pump assembly of claim 7 wherein said tube is removable and replaceable permitting replacement of said valve without requiring disassesmbly of the fluid pump.

10. The fluid pump assembly of claim 7 including a second valve adapted to permit a flow of fluid therethrough substantially in the single direction, said second valve connected to said tube at an opposite side of said conduit from said first valve.

11. The fluid pump assembly of claim 7 further comprising an enclosure which receives and contains said pump chamber, said diaphragms, and at least a portion of said conduit.

12. The fluid pump assembly of claim 11 wherein said enclosure has a port, and wherein said tube is received through said port and contained within said enclosure.

13. A fluid pump comprising:
- a pump chamber open to two sides;
- a pair of diaphragms for sealing the open sides of said pump chamber;
- a substantially rigid tube for conveying fluid;
- a conduit for connecting said pump in fluid communication with said tube; and
- a pair of valves located along said tube on either side of said conduit, said valves adapted to direct a flow of fluid through said tube substantially in a single direction.

14. The fluid pump of claim 13 wherein said conduit and said tube are removable and replaceable from said pump chamber.

15. The fluid pump of claim 13 wherein said conduit includes a membrane preventing mixing between fluid in said pump chamber and fluid in said tube.

16. The fluid pump of claim 13 wherein said pump chamber includes no valves.

17. The fluid pump of claim 13 wherein said pump chamber is relatively remotely located from said tube.

18. The fluid pump of claim 13 wherein said conduit is substantially rigid.

19. The fluid pump of claim 13 wherein said tube is removable and replaceable permitting replacement of said valves without requiring disassembly of said pump chamber.

20. A fluid pump assembly comprising:
- a valveless pump chamber open to at least one side;
- a diaphragm for sealing the open side of said pump chamber;
- a tube for conveying fluid;
- a conduit for connecting said pump chamber in fluid communication with said tube;
- a pressurized enclosure for receiving and containing at least said pump chamber, said diaphragm, at least a portion of said tube, and said conduit; and at least one valve connected to said tube, and adapted to permit a flow of fluid therethrough substantially in a single direction.

21. The fluid pump assembly of claim 20 wherein said tube is substantially rigid.

22. The fluid pump assembly of claim 20 wherein said tube is removable and replaceable permitting replacement of said valve without requiring disassembly of the fluid pump.

23. The fluid pump assembly of claim 20 wherein said enclosure also receives and contains said valve.

24. The fluid pump assembly of claim 20 wherein said enclosure has a sealable port, and wherein said tube is received through said port and contained within said enclosure.

25. The fluid pump assembly of claim 20 including a second valve adapted to permit a flow of fluid therethrough substantially in the single direction, said second valve connected to said tube at an opposite side of said conduit from said first valve.

* * * * *